United States Patent [19]

Baldwin

[11] Patent Number: 5,024,347

[45] Date of Patent: Jun. 18, 1991

[54] ADJUSTABLY CONTROLLABLE ACCURACY-ENHANCING PUMP ARRANGEMENT AND METHOD

[76] Inventor: Brian E. Baldwin, 7891 S. Argonne St., Aurora, Colorado 80016

[21] Appl. No.: 203,924

[22] Filed: Jun. 8, 1988

[51] Int. Cl.[5] ..... B67B 7/00

[52] U.S. Cl. ..... 222/1; 222/14; 222/214; 417/477

[58] Field of Search ..... 222/14, 63, 207, 214, 222/1, 55; 417/44–45, 22, 477; 604/30, 65, 67; 364/510

[56] References Cited

U.S. PATENT DOCUMENTS

| | | | |
|---|---|---|---|
| 4,108,575 | 8/1978 | Schal | 417/53 |
| 4,217,993 | 8/1980 | Jess et al. | 222/14 |
| 4,331,262 | 5/1982 | Snyder et al. | 222/63 X |
| 4,670,007 | 6/1987 | Wheeldon et al. | 604/65 |
| 4,715,786 | 12/1987 | Wolff et al. | 417/22 |

*Primary Examiner*—Michael S. Huppert
*Assistant Examiner*—Gregory L. Huson
*Attorney, Agent, or Firm*—Reginald F. Pippin, Jr.

[57] ABSTRACT

An adjustably controllable accuracy-enhancing pump arrangement and method is disclosed, as embodied in a digitally pulse-driven rotary peristaltic pump having a rotor which acts on a fluid pumping conduit to effect pumped output of fluid. Inaccuracies in volume pumped for a given quantity of pulses applied to the pump intended to effect a selected desired volume are minimized by adjusting the total quantity of pulses applied to the pump for a given desired volume, and/or for subsequent selected volumes, if desired, as a function of an adjustment factor formed by the ratio of the given desired volume relative to actual volume pumped by the application to the pump of the quantity of pulses estimated or calculated to be required for pumping the given desired volume through a given sized tube set conduit.

31 Claims, 1 Drawing Sheet

ADJUSTABLY CONTROLLABLE ACCURACY-ENHANCING PUMP ARRANGEMENT AND METHOD

DESCRIPTION OF THE INVENTION

Figure 1:
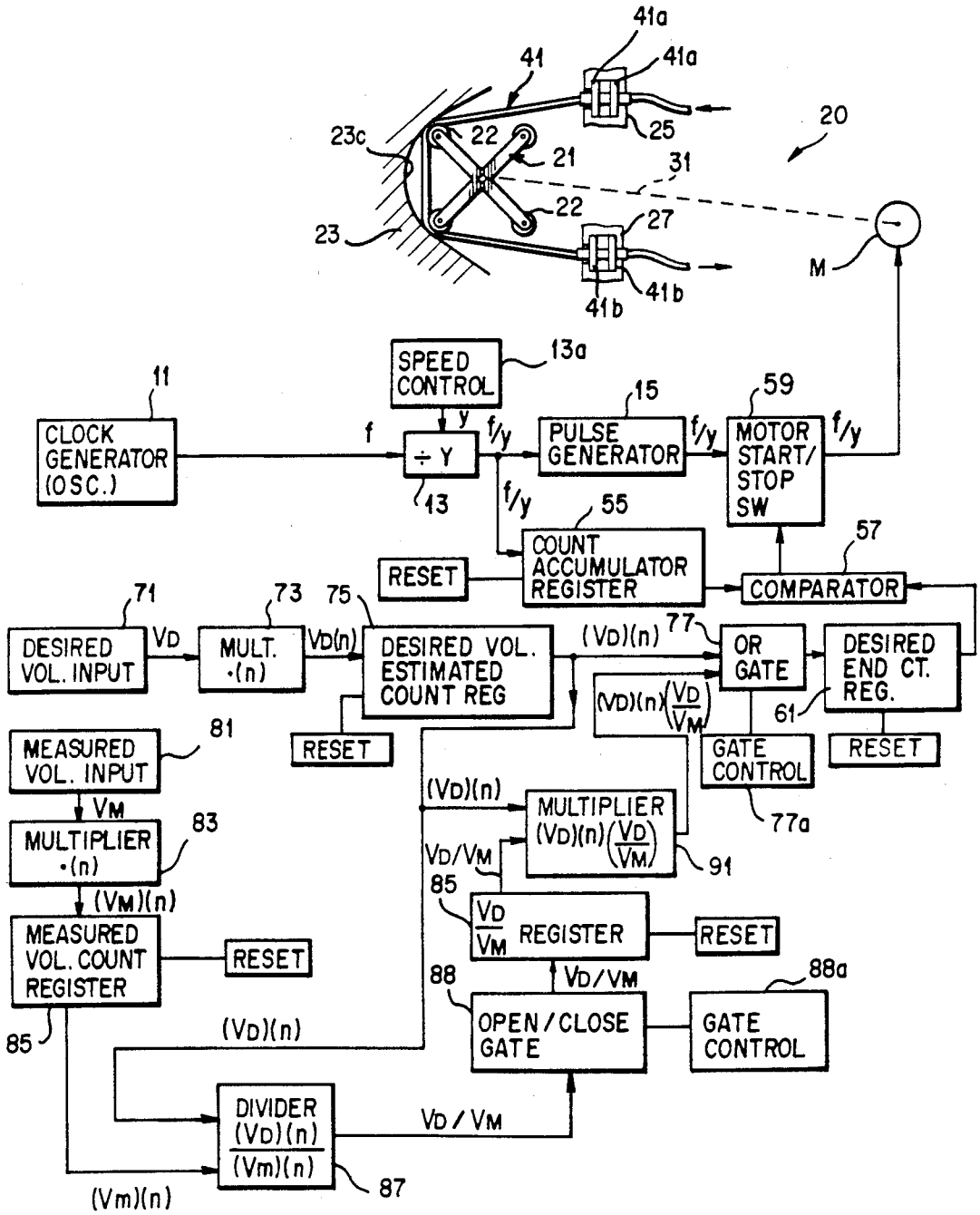

This invention relates to the pumping of various fluids by digitally incrementally actuated motor-driven peristaltic pumps, such as pulse-actuated rotary stepping motor-driven rotary peristaltic pumps, and more particularly to an improved digitally incrementally actuated peristaltic rotary pump arrangement and method which enables simple and easy enhancement of accuracy of the output quantity of fluid pumped by the pump, and which improved pump arrangement and method is particularly useful for the pharmaceutical use area where a high degree of accuracy is frequently required in pumping various fluids for various purposes.

Conventionally, rotary peristaltic pumps have heretofore utilized stepping motors to incrementally actuate a peristaltic pump rotor to thereby pump a selected fluid through a peristaltic pumping conduit which is typically formed by a tube set having flexible inlet and outlet tubes connected by a peristaltic pumping tube section of desired ID to effect a desired flow rate. Some of such pumps have employed computer controls for controlling the number of pulses fed to the pump-driving stepping motor. However, there are many variables affecting the accuracy of a specific tube set and application. The pump may calculate the theoretical required number of rotary steps for a known tube diameter, pump speed, inlet and outlet pressure and other variables if known. However, as a practical matter for a pump such as this with a wide variety of applications, it is not possible to know all of the variables.

Further, the accuracy of a rotary peristaltic pump is dependent on a large number of variables, including inside diameter accuracy, wall thickness accuracy, length of the pump tube or stretch over the rollers, elasticity of the rubber, speed of the rotor, line suction pressure at the inlet and the flow restriction and outlet back pressure.

In addition, there will be some tolerance in the tube dimensions or physical characteristics which will affect accuracy.

All of the above variables, and probably other factors also, make it impossible to precisely accurately compute the fluid output of a rotary peristaltic pump in terms of the total movement of pump rotor relative to the pumping conduit or tube set. It is an object and feature of the invention to enable achievement of high accuracy with ease, by entering the actual first cycle delivered volume into the controls of the pump and to have this data used in computing the needed accuracy adjustment in total rotation movement of the pump rotor and its rollers, so that subsequent pumping cycles, under the same operating conditions and for the same volume, will be adjusted by the same accuracy adjustment factor and will thus have a highly accurate adjustment-corrected adjusted total rotor movement for the given volume.

For many pharmacy operations, the tube set employed, as well as other operating conditions such as inlet pressure drop and outlet back pressure, will remain constant for succeeding fill cycles, with the only change being the desired delivered volume. It is accordingly a further object and feature of the invention immediately indicated above that after an accuracy adjustment factor is determined for the first volume setting, such accuracy adjustment factor may thereafter be selectively automatically carried over and applied for additional fill cycles, including those fill cycles for which the volume is changed.

It is accordingly an object and feature of this invention to provide an accuracy-enhancing method and apparatus which enables accuracy adjustment by simply employing the measured actual volume pumped and the desired pumped volume to effect a new actual volume pumped which will be adjusted for the difference between the desired and previously measured output volume.

It is a further object and feature of the invention to provide a method an apparatus which enables enhancement of accuracy of pumped volumes by digitally actuated peristaltic pumps, in which an adjustment factor is formulated and may be repeatedly applied to pumping cycles for any selected quantity or quantities, and which adjustment factor is a function of a desired volume input quantity value relative to a measured actual volume pumped as a result of input of such desired quantity value.

Still a further object and feature of the invention is to provide a pump and method in which accuracy of pumping may be readily and simply enhanced by formulating and applying a correction factor based on a desired volume input for a given pumping conduit tube set relative to the measured actual volume pumped with such desired volume input, and in which such adjustment factor may be repeatedly reapplied, without need for reformulation, to subsequent pumping cycles for pumping the same quantity as originally desired or for pumping various different quantities desired to be pumped for the same fluid and fluid-pumping conduit arrangement.

Still other objects and attendant advantages will become apparent from a reading of the following detailed description of an illustrative and preferred embodiment and mode of practice of the invention, taken in conjunction with the accompanying drawing, wherein:

FIG. 1 is an electromechanical schematic block diagram illustrating an embodiment and mode of practice of the invention.

To provide the user with a simple and easy recalibration adjustment, this invention utilizes a means of inputting the actual delivered volume from a measured initial test volume delivered by the pump. The computer control will then calculate the ratio of the desired volume relative to the actual delivered volume and use this ratio to modify the number of pulsed rotary steps of the stepping motor to provide the desired correct volume. The computer may then collectively retain the adjustment or correction ratio in memory, if desired, so that this correction can be made for subsequent input desired volumes when the same tube set and inlet/outlet conditions exist.

Referring now to FIG. 1 of the drawing, a suitable clock generator 11, which may be formed by a fixed-rate or adjustable-rate oscillator (although a stable fixed frequency oscillator such as a quartz controlled oscillator is preferred) feeds a higher frequency (e.g., 4 Mhz) signal than will be utilized for pump operation, through an adjustable divider 13 which provides a suitable lower frequency signal which is within a frequency range acceptable by a stepping motor M.

The output frequency of divider 13 may be suitably controllably varied by a speed control 13*a* which may function to vary the speed of motor M by varying the divisor y inputted to divider 13. The desired suitably lower frequency signal output from divider 13 is fed to a count accumulator register 55 and to a pulse generator 15 which forms pulses at the same frequency and having characteristics suitable for driving a rotary stepping motor M which in turn rotates a rotor 21 as by a common shaft connection 31 from the stepping motor M to rotor 21 of a peristaltic pump 20, relative to a fixed stator 23 having a constant radius peristaltic pumping surface 23*c* whose center of radius is the same as rotor 21.

Rotor 21 preferably has rollers 22 at its ends for progressive rolling peristaltic squeezing pumping contact with a pumping conduit 41 which may be removably mounted along the pumping zone between the face 23*c* of stator 23 and the rotor 21.

The peristaltic pump 20 has laterally open-slotted connector/anchor elements 25, 27 at its input and output ends for removably connecting a flexible pumping conduit thereto and for effectively anchoring the conduit 41 in position to withstand the longitudinal pulling motion exerted thereon by the rotation of the rotor 21 thereagainst during peristaltic pumping action. Concomitantly, the flexible pumping conduit 41 has spaced pairs of flanges 41*a* and 41*b* formed thereon for laterally slidably removable anchoring engagement with respective slotted connector/anchor elements 25, 27.

The output of count accumulator register 55 is continuously inputted to a comparator 57 whose other input is from a desired end count register 61. When the count accumulator register 55 has accumulated a count equal to that in the desired end count register 61, the comparator forms an output signal which actuates and opens previously closed motor start/stop control switch 59 through which the motor-actuating pulse output from pulse generator 15 is fed to motor M. This opening of switch 59 blocks the feeding of pulses to the motor M, thus effectively stopping the motor M and drive shaft 31 and thereby cutting off further driven rotation of rotor 21 and concomitant pumping of fluid by the pump 20.

The desired end count register 61 is set to a desired value by inputting a desired volume and/or by subsequently inputting an actual measured volume $V_M$ resulting from operation of the pump 20 based on the initial setting of a desired volume $V_D$. As is subsequently described, the measured volume $V_M$ may be utilized in conjunction with the desired volume $V_D$ to adjust the desired end count register 61 to reflect any noted difference in actual flow rate through the given conduit 41 or 151 relative to the expected estimated or calculated flow rate.

Desired volume $V_D$ may be suitably inputted in digital form at desired volume input 71 as by a touch pad or keyboard which accommodates volume quantity inputs, e.g., liter, ml, etc, and this input 71 is fed to a multiplier 73 which converts the value $V_D$ to a suitable corresponding count $(N_D)(n)$ by multiplication by a constant n which correlates with the pulse quantity/volume estimated or calculated to be pumped by the stepping motor-driven pump 20 for a pumping conduit of the base size which causes direct feeding of count accumulator register 55, as distinguished from the indirect feeding thereof through multiply/divide adjuster 53.

The resulant product output $(V_D)(n)$ is fed to a desired volume estimated count register 75 which has been suitably reset to zero prior to entry of the desired volume count $(N_D)(n)$.

Initially, the output $(V_D)(n)$ of register 75 is passed through OR gate 77 to the desired end count register 61, the output of which register 61 in turn is inputted as one comparison input to comparator 57, against which comparison input the comparator compares as its other comparison input the running count accumulation output from count accumulator register 55. Thus, when the set quantity in register 61 is equalled by the accumulated count in register 55 the comparator 57 will actuate the motor start/stop switch 59 to off or open condition, where it will remain until it is again manually or otherwise suitably automatically or otherwise reactuated to on or closed condition.

While the calculated or estimated value n of pulses/unit volume as employed may provide an acceptable degree of accuracy in some instances, there may nevertheless be situations where greater accuracy is required in the actual volume of fluid delivered. To this end, according to the invention, provision is made for adjustment of the desired volume estimated count value $(V_D)(n)$ by a factor which effectively substantially compensates for the difference between the desired pumped volume and the actual measured pumped volume $V_M$ resulting from use of the calculated or estimated pulses/quantity pumped. According to a preferred mode of practice of the invention, after conclusion of operation of the pump 20 with a given tube set fluid conduit 41 or 151 and fluid being pumped, the volume $V_M$ of fluid pumped from the conduit 41 is measured, either visually or otherwise as desired. It has been found that, for most normal conditions and requirements, personal visual measurement is adequate to provide an acceptable basis for adjustment of the pumped volume $V_M$ to a value well within acceptable tolerance limits relative to the desired volume $V_D$.

According to this aspect of the invention, the measured volume $V_M$, resulting from operation of the pump when a desired volume $V_D$ has been inputted, is inputted as through manual actuation of measured volume input unit 81, which may be a keyboard, touchpad or other suitable digital input device, the measured value $V_M$ being inputted being in the same selected unit of measure for quantity as employed for inputting the desired input $V_D$. This value is multiplied in multiplier 83 by the factor n to provide a measured volume count $(V_M)(n)$ which is inputted to cleared measured volume count register 85, the output $(V_M)(n)$ of which is inputted as the divisor to divider 87. Also inputted to divider 87 as the dividend therefore is the count value $(V_D)(n)$ from the volume estimated count register 75. The quotient $V_D/V_M$ output from divider 87 reflects in usable nearest digital count value forms the ratio of the desired volume $V_D$ relative to the actual measured volume $V_M$ produced by employing the estimated or calculated multiple n to provide the pulse quantity $(V_D)(n)$ for operation of the pump 20 in an effort to pump the desired volume $V_D$.

Output $V_D/V_M$ from divider 85 is fed through selectively opened normally closed gate 88 into cleared register 89, after which gate 88 is closed until a new value $V_D/V_M$ is desired to be inputted to register 89, at which latter time register 89 may be cleared by its reset input, and gate control 88*a* may be actuated to open gate 88 and permit passage of the new value of $V_D/V_M$ into $V_D/V_M$ register 89.

The output $V_D/V_M$ of register 89 is continuously available and inputted as one multiplier input into multiplier 91, the other input to multiplier 91 being the desired volume estimated count $(V_D)(n)$ from register 75. The product $(V_D^2)(n)/(V_M)$ is a count value (which may be suitably rounded off to the nearest whole digital value) which reflects the original estimated count $V_D(n)$ adjusted by the ratio or percentage adjustment factor $V_D/V_M$ to thereby make a correction for the measured variation in pumped quantity resulting from use of this count value $(V_D)(n)$ as the pulse generating input for pump 20.

Register 61 is suitably reset/cleared, and the OR gate 77 is thereupon actuated by a suitable gate control 79 to switch the input to the cleared desired end count register 61 so that the output $(V_D^2)(n)/(V_M)$ from multiplier 91 is inputted through OR gate 77 to the desired end count register 61. Thereupon, the pump 20 is restarted by start actuation of start/stop switch 59, and when the count accumulator register 55 registers the same number of counts as the count value $(V_D^2)(n)/V_M$ outputted from the desired end count register 61, the comparator 57 effects an output signal which actuates the on/off switch to its normal off condition, thereby blocking passage of further pulses from pulse generator 15 to motor M and thus effectively stopping the pulse driven actuation of motor M and pump 20 driven thereby. The pumped quantity of the given fluid through the given conduit 41 will thus be an amount which is adjusted for the measured difference between the desired volume $V_D$ and the measured volume $V_M$, the adjustment representing a ratio of increase or decrease reflected by the product of the desired volume $V_D$ multiplied by the adjustment factor ratio of the desired volume $V_D$ relative to the measured volume $V_M$.

The $V_D/V_M$ register 89 may retain its registered value until such register 89 is reset and gate 88 is subsequently opened to enable registry of a new value $V_D/V_M$ therein, as may result from pumping action with different conditions, such as using a different pumping conduit 41 , and/or pumping a different fluid. Thus, by retaining the value $V_D/V_M$ in memory register 89, additional further desired volume quantities $V_D$, which may be the same as previously inputted at desired volume input 71 may again be outputted by pump 20 by merely start reactuating start/stop switch 59, as the desired end count register 261 will retain the adjusted desired end count for the previous desired volume input $V_D$ until reset. Alternatively, the previously determined ratio value $V_D/V_M$ may be retained in register 89 and reused as a further input to multiplier 91, for a desired new input value of $V_D$ inputted through input 71 and multiplier 73 to cleared desired volume estimated count register 75, and by operating OR gate 77 to pass the resulting new output $(V_D^2)(n)/(V_M)$ to desired end count register 61, the same previously resulting correction or adjustment factor $V_D/V_M$ applicable for operation of the pump 20 to pump an identically proportionately adjusted more accurate quantity of fluid will be reflected in the pump operation, without necessity for again measuring the quantity pumped and inputting such through input 81, with essentially the same degree of corrected accuracy, assuming the same conditions are maintained for the pump, including same pump speed, same conduit, and same fluid, etc., the only operating difference being the desired volume quantity $V_D$. When any condition other than desired volume to be pumped is changed, it is desirable that the $V_D/V_M$ register be cleared, and the previously described test pumping, measuring and, if necessary, adjusting of fluid quantity pumped, by forming and registry in register 89 of a new adjustment factor $V_D/V_M$ by appropriately opening and then closing of gate 88 as by gate control 88*a*.

While the foregoing system and method has been illustrated and described generally in hardware form and terms, it will be appreciated that such may be, and in a given instance may preferably be, effected in large measure by suitable corresponding software and/or firmware programming and operation of a computer or computers by such programming in conjunction with such hardware of the system as may be deemed desirable.

While the invention has been illustrated and described with respect to illustrative embodiments and modes of practice, it will be apparent to those skilled in the art that various modifications and improvements may be made without departing from the scope and spirit of the invention. Accordingly the invention is not to be limited by the illustrative embodiments and modes of practice, but only by the scope of the appended Claims.

I claim:

1. The method of reducing inaccuracy in total quantity of fluid pumped by a pump comprising:

actuating a pump through a first given amount of pump activity which is estimated will yield a first selected output quantity of a given fluid pumped through a given conduit based on assumed calibration factor of a selected amount of pump activity per unit volume dispensed, measuring the amount of the actual output quantity of said fluid which is pumped through said conduit by said first given amount of pump activity, and applying an adjustment factor to the amount of pump activity which would be calculated to be required based on said assumed calibration factor, for further pumping activity to effect selected further pumped output quantity production, said adjustment factor when applied as a multiplier being equal to the ratio of said first selected output quantity of fluid pumped relative to said measured actual output quantity of fluid pumped, for further pumping of a said selected further output quantity.

2. The method according to claim 1, further comprising applying the respective said adjustment factor to subsequent pump activity for pumping selected further pumped output quantities of said given fluid through said given conduit whether the same as or different from said first selected output quantity.

3. The method according to claim 1, further comprising subsequently changing said given conduit to a second conduit having a fluid flow rate characteristic different from that of said first conduit, actuating a pump through a further given amount of pump activity which is considered will yield a second selected output quantity of a given fluid pumped through said second given conduit, measuring the amount of the actual output quantity of said fluid which is pumped through said conduit by said further given amount of pump activity, and adjusting the said further given amount of pump activity of said pump, when pumping its output through said second conduit, by a second adjustment factor multiple equal to the ratio of said second selected output quantity of fluid pumped relative to said measured actual output quantity of fluid pumped through a said second conduit when said pump is actuated through said further given amount of pump activity.

4. The method according to claim 3, and applying said second adjustment factor to subsequent pump activity for pumping a selected further pumped output quantity of said given fluid through said second given conduit, as may be desired, independent of whether such selected further pumped output quantity is the same as or different from said second selected output quantity.

5. The method according to claim 1, further comprising:

subsequently changing said given fluid to a selected second fluid having a flow rate characteristic different from that of the previously pumped said given fluid, actuating a pump through a further amount of pump activity which is considered will yield a further selected output quantity of said selected second fluid pumped through a particular conduit, measuring the amount of the actual output quantity of said selected second fluid which is pumped through said particular conduit by said further amount of pump activity, and adjusting the said further amount of pump activity by an adjustment factor multiple equal to the ratio of said further selected output quantity of fluid pumped relative to said measured actual output quantity of said selected second fluid pumped.

6. The method according to claim 5, further comprising:

applying the respective said adjustment factor to pump activity for pumping a selected further pumped output quantity of at least one of said given fluid and said selected second fluid.

7. The method according to claim 1, further comprising:

applying said adjustment factor to subsequent pump activity for further pumping of a selected further pumped output quantity of said given fluid through said given conduit independent of whether such selected further pumped output quantity is the same as or different from said first selected output quantity.

8. The method according to claim 7, said applying of said adjustment factor to said subsequent pump activity being for pumping of a quantity of fluid different from said first selected output quantity.

9. The method according to claim 7, said applying of said adjustment factor to said subsequent pump activity being for pumping of a quantity of fluid the same as said first selected output quantity.

10. The method according to claim 7, said applying of said adjustment factor to said estimated quantity of subsequent pump activity being for pumping of both at least one quantity of fluid the same as said first selected output quantity and at least one quantity of fluid different from said first selected output quantity.

11. The method of reducing inaccuracy in the amount of output fluid pumped through a conduit by a digitally incrementally operable pump, comprising actuating a digitally incrementally operable pump through a first given amount of pump activity represented by a first quantity of digital increments, which is estimated will yield a first selected output quantity of a given fluid pumped through a given conduit based on an assumed calibration factor of a selected amount of pump activity per unit volume dispensed, measuring the amount of the actual output quantity of said fluid which is pumped through said conduit by said first given amount of pump activity represented by said first quantity of digital increments, applying an adjustment factor to the amount of pump activity which would be calculated to be required based on said assumed calibration factor, for further pumping activity to effect selected further pumped output quantity production, said adjustment factor when applied as a multiplier being equal to the ratio of said first selected output quantity of fluid pumped relative to said measured actual output quantity of fluid pumped as a result of said estimated number of increments of actuation of said pump, for further pumping of a said selected further pumped output quantity, and subsequently a selected output quantity of said given fluid through said conduit by actuating said pump a number of increments equal to the product of said estimated quantity of increments corresponding to said selected output quantity multiplied by said adjustment factor.

12. The method according to 11, further comprising applying said adjustment factor to subsequent pump activity for pumping a subsequent selected pumped output quantity of said given fluid through said given conduit whether the same as or different from said first selected output quantity.

13. The method according to claim 11, further comprising:

applying said adjustment factor to subsequent pump activity for pumping a further selected pumped output quantity of said given fluid through said given conduit independent of whether such selected further pumped output quantity is the same as or different from said first selected output quantity.

14. The method of reducing inaccuracy in the output amount of a given fluid pumped through a selected conduit by a stepping motor-driven pump, comprising pulsing a stepping motor-actuated pump a given number of actuating pulses estimated as corresponding to a first desired output quantity of selected fluid output of a given fluid through a selected conduit based on a first ratio of n estimated pulses/unit volume pumped, and said number of pulses being equal to the product of said desired quantity of selected fluid multiplied by said first ratio, measuring the actual first output quantity of said given fluid pumped through said conduit as a result of pulse-actuating said pump said given number of actuating pulses, and subsequently pulsing said stepping motor-actuated pump for outputting any selected user quantity of said given fluid through said conduit by pulsing said stepping motor-actuated pump a number of pulses equal to the product of said selected user quantity of fluid multiplied by said first ratio and by a further second corrective adjustment factor which is the ratio formed by said first desired output quantity divided by said measured actual first output quantity.

15. The method according to claim 14, further comprising:

applying said adjustment factor to subsequent pump activity for pumping a selected further pumped output quantity of said given fluid through said given conduit independent of whether such selected further pumped output quantity is the same as or different from said first selected user quantity to have been outputted theretofore.

16. The method according to claim 14, further comprising:

applying said adjustment factor to subsequent pump activity for pumping selected further pumped output quantities of said given fluid through said given conduit independent of whether such selected further pumped output quantities are the same as or different from the previous said selected user quantity to have been outputted theretofore.

17. A pump arrangement enabling reduction of inaccuracy in the amount of output fluid pumped through a conduit by a digitally incrementally operable pump, comprising a digitally incrementally operable pump, means for actuating said pump through a first given amount of pump activity represented by a first quantity of digital increments, which is estimated will yield a first selected output quantity of a given fluid pumped through a given conduit based on an assumed calibration factor of a selected amount of pump activity per unit volume dispensed, means for applying an adjustment factor to the amount of pump activity which would be calculated to be required based on said assumed calibration factor, for further pumping activity to effect selected further pumped output quantity production, said adjustment being applied as a multiplier which is equal to the ratio of said first selected output quantity of fluid pumped relative to an actual measured output quantity of fluid pumped through a given said conduit as a result of said estimated number of increments of actuation of said pump, and means for subsequently pumping a selected output quantity of said given fluid through said conduit by actuating said pump a number of increments equal to the product of said adjustment factor and said estimated quantity of increments corresponding to said selected output quantity.

18. Apparatus according to claim 17, further comprising:

means for applying said adjustment factor to subsequent pump activity for pumping a further selected pumped output quantity of a said given fluid through a said given conduit independent of whether such selected further pumped output quantity is the same as or different from said first selected output quantity.

19. A pump arrangement which enables reduction of inaccuracy in the output amount of a given fluid pumped through a selected conduit by a pulse-actuated pump, comprising a digital pulse-actuated pump, means for pulsing said pump a given number of actuating pulses estimated as corresponding to a first desired output quantity of a selected fluid output by said pump of a given fluid through a selected conduit based on a first ratio of n estimated pulses/unit volume pumped, and said number of pulses being equal to the product of said desired quantity of selected fluid multiplied by said first ratio, and means for subsequently pulsing said digital pulse-actuated pump for outputting any selected user quantity of said given fluid through said conduit by pulsing said stepping motor-actuated pump a number of pulses equal to the product of said selected user quantity of fluid multiplied by said first ratio and by a further second corrective adjustment factor which is the ratio formed by said first desired output quantity divided by an actual first output quantity from said pump when said pump is actuated a number of pulses equal to said product of said desired quantity multiplied by said first ratio,.

20. Apparatus according to claim 19, further comprising: means for applying said adjustment factor to subsequent pump activity of said pump for pumping a selected further pumped output quantity of a said given fluid through said given conduit independent of whether such selected further pumped output quantity is the same as or different from said first selected user quantity to have been outputted theretofore.

21. Apparatus according to claim 19, further comprising: means for applying said adjustment factor to subsequent pump activity for said pump for pumping selected further pumped output quantities of said given fluid through said given conduit independent of whether such selected further pumped output quantities are the same as or different from the previous said selected user quantity to have been outputted theretofore.

22. A pump arrangement enabling reduction of inaccuracy in total quantity of fluid pumped by a pump, comprising: a pump, means for actuating said pump through a first given amount of pump activity which is estimated will yield a first selected output quantity of a given fluid pumped through a given conduit based on an assumed calibration factor of a selected amount of pump activity per unit volume dispensed, and means for applying an adjustment factor to the amount of pump activity which would be calculated to be required based on said assumed calibration factor, said adjustment factor being a multiplier which is equal to the ratio of said first selected output quantity of fluid pumped relative to an actual measured output quantity of fluid pumped through a said given conduit by said pump when said pump is actuated by said first given amount of pump activity, for further pumping of said selected further output quantity.

23. The method according to claim 22, further comprising means for applying the respective said adjustment factor to selected subsequent pump activity of said pump for pumping selected further pumped output quantities of said given fluid through said given conduit whether the same as or different from said first selected output quantity.

24. Apparatus according to claim 22, further comprising:

means for subsequently changing said given conduit to a second conduit having a fluid flow rate characteristic different from that of said first conduit, means for actuating said pump through a further given amount of pump activity which is considered will yield a second selected output quantity of a given fluid pumped through said second given conduit, and means for adjusting the said further given amount of pump activity of said pump, when pumping its output through said second conduit, by a second adjustment factor multiple equal to the ratio of said second selected output quantity of fluid pumped relative to an actual measured output quantity of fluid pumped through a said second conduit when said pump is actuated through said further given amount as pump activity.

25. Apparatus to claim 24, and means for applying said second adjustment factor to subsequent pump activity for pumping a selected further pumped output quantity of said given fluid through said second given conduit, as may be desired, independent of whether such selected further pumped output quantity is the same as or different from said second selected output quantity.

26. Apparatus according to claim 22 further comprising:

means for actuating said pump through a further amount of pump activity by said pump which is considered will yield a further selected output quantity of a selected second fluid pumped through a particular conduit, which second fluid has a flow rate characteristic different from that of the previously pumped said given fluid, and means for adjusting the said further amount of pump activity by an adjustment factor multiple equal to the ratio of said further selected output quantity of fluid pumped relative to an actual measured output quantity of said selected second fluid pumped by said pump as a result of said further amount of pump activity.

27. The method according to claim 26, further comprising:

means for applying the respective said adjustment factor to additional pump activity of said pump for pumping a selected further pumped output quantity of at least one of said given fluid and said selected second fluid.

28. Apparatus according to claim 22, and means for applying said adjustment factor to subsequent pumping activity of said pump for further pumping of a selected further pumped output quantity of said given fluid through a said given conduit independent of whether such selected further pumped output quantity is the same as or different from said first selected output quantity.

29. Apparatus according to claim 28, said means for applying of said adjustment factor to said subsequent pump activity comprising means for pumping of a quantity of fluid different from said first selected output quantity.

30. Apparatus according to claim 28, said means for applying of said adjustment factor to said subsequent pump activity comprising means for pumping of a quantity of fluid the same as said first selected output quantity.

31. Apparatus according to claim 28, said means for applying of said adjustment factor to said estimated quantity of subsequent pump activity including means for pumping of both at least one quantity of fluid the same as said first selected output quantity and at least one quantity of fluid different from said first selected output quantity.

* * * * *

UNITED STATES PATENT AND TRADEMARK OFFICE

CERTIFICATE OF CORRECTION

PATENT NO. : 5,024,347
DATED : June 18, 1991
INVENTOR(S) : Brian E. Baldwin

It is certified that error appears in the above-identified patent and that said Letters Patent is hereby corrected as shown below:

IN THE DRAWING:

The reference numeral for the $V_D/V_M$ Register should be --- 89 --- instead of "85".

Col.2, Line 14, "an" should be --- and ---.

Col. 3, Line 21, --- 41 --- should be inserted after "conduit".

Col. 3, Line 66, "resulant" should be --- resultant ---.

Col. 4, Line 2, $(N_D)(n)$ should be --- $(V_D)(n)$ ---.

Col. 4, Line 51, "therefore" should be --- therefor ---.

Col. 4, Line 54, " forms" should be --- form ---.

Col. 5, Line 14, "79" should be --- 77a ---.

Col. 6, Line 20, a comma --- , --- should be inserted after "Accordingly".

UNITED STATES PATENT AND TRADEMARK OFFICE

CERTIFICATE OF CORRECTION

PATENT NO. : 5,024,347

DATED : June 18,1991

INVENTOR(S) : Brian E. Baldwin

It is certified that error appears in the above-identified patent and that said Letters Patent is hereby corrected as shown below:

Claim 1, Line 2 (Col. 6, Line 26), a comma --- , --- should be inserted after "pump".

Claim 1, Line 6 (Col. 6, Line 30), --- an --- should be inserted after "on".

Claim 2, Line 3 ( Col. 6, Line 48), "the respective" should be deleted.

Claim 3, Line 3 (Col. 6, Line 55), --- given -- should be inserted after "second".

Claim 11, Line 28, (Col. 8, Line 25), --- pumping --- should be inserted before "a".

UNITED STATES PATENT AND TRADEMARK OFFICE

CERTIFICATE OF CORRECTION

PATENT NO. : 5,024,347
DATED : June 18, 1991
INVENTOR(S) : Brian E. Baldwin

It is certified that error appears in the above-identified patent and that said Letters Patent is hereby corrected as shown below:

Claim 17, Line 4 (Col. 9, Line 24) should continue after "by" in Line 3 (Col. 9, Line 23) as a part of the Claim preamble.

Claim 17, Line 19 (Col. 9, Line 39), --- factor --- should be inserted after " adjustment".

Claim 17, Lines 22 and 23 (Col. 9, Lines 42 and 43), "a given said" should be --- a said given ---.

Claim 19, Line 17 (Col. 10, Line 8), "stepping motor-actuated" should be --- digital pulse-actuated ---.

Claim 22, Line 3 (Col. 10, Line 36), "a pump," should begin and constitute a separate new indented line/subparagraph.

UNITED STATES PATENT AND TRADEMARK OFFICE

CERTIFICATE OF CORRECTION

PATENT NO. : 5,024,347
DATED : June 18, 1991
INVENTOR(S) : Brian E. Baldwin

It is certified that error appears in the above-identified patent and that said Letters Patent is hereby corrected as shown below:

Claim 22, Line 19 (Col.10, Line 52), --- further --- should be inserted before "said"

Line 20 (Col. 10, Line 53), "further" should be deleted.

Claim 23, Line 1 (Col.10, Line 54), "The method" should be --- Apparatus ---.

Claim 24, Line 19 (Col.11, Line 12), "as" should be --- of ---.

Claim 25, Line 1 (Col.11, Line 13). --- according --- should be inserted after "Apparatus".

Claim 27, Line 1 (Col.12, Line 3), "The method" should be ---Apparatus---.

Signed and Sealed this

Twenty-first Day of April, 1992

*Attest:*

HARRY F. MANBECK, JR.

*Attesting Officer*

*Commissioner of Patents and Trademarks*

US005024347A

REEXAMINATION CERTIFICATE (2587th)

United States Patent [19]

Baldwin

[11] B1 5,024,347

[45] Certificate Issued May 23, 1995

[54] ADJUSTABLY CONTROLLABLE ACCURACY-ENHANCING PUMP ARRANGEMENT AND METHOD

[75] Inventor: Brian E. Baldwin, Aurora, Colo.

[73] Assignee: Baxa Corporation, Englewood, Colo.

Reexamination Request:
No. 90/003,547, Aug. 31, 1994

Reexamination Certificate for:

| | |
|---|---|
| Patent No.: | **5,024,347** |
| Issued: | **Jun. 18, 1991** |
| Appl. No.: | **203,924** |
| Filed: | **Jun. 8, 1988** |

Certificate of Correction issued Jun. 18, 1991.

[51] Int. Cl.[6] ..... B67B 7/00

[52] U.S. Cl. ..... 222/1; 222/14; 222/214; 417/477

[58] Field of Search ..... 222/1, 14, 55, 63, 207, 222/214; 417/44, 45, 22, 477; 604/30, 65, 67; 364/510

[56] References Cited

U.S. PATENT DOCUMENTS

| | | | |
|---|---|---|---|
| 4,498,843 | 2/1985 | Schneider et al. | 417/22 |
| 4,830,218 | 5/1989 | Shirkhan | 222/52 |
| 4,831,866 | 5/1989 | Forkert et al. | 73/3 |

OTHER PUBLICATIONS

FMS-100 Operator's Manual; Jan., 1987.
Prosecution history of U.S. Pat. No. 4,498,843.
1987-88 Cole-Parmer catalog; Jan., 1987, p. 654.
Software Operator's Manual for the Masterflex Computerized Drive, A-1299-231, Ed. 1487, Jan., 1987.
Deposition of Robert M. Rymarczyk—Admitted Prior Art.
Exhibits 159 and 160 to Rymarczyk Deposition—Admitted Prior Art.
Operating & Service Manual for the ADS 100 Pump Jan., 1984.
Baxa's Responses to Excelsiors's Requests for Admissions, Oct., 1992 Admission of Requestor.

*Primary Examiner*—Gregory L. Huson

[57] ABSTRACT

An adjustably controllable accuracy-enhancing pump arrangement and method is disclosed, as embodied in a digitally pulse-driven rotary peristaltic pump having a rotor which acts on a fluid pumping conduit to effect pumped output of fluid. Inaccuracies in volume pumped for a given quantity of pulses applied to the pump intended to effect a selected desired volume are minimized by adjusting the total quantity of pulses applied to the pump for a given desired volume, and/or for subsequent selected volumes, if desired, as a function of an adjustment factor formed by the ratio of the given desired volume relative to actual volume pumped by the application to the pump of the quantity of pulses estimated or calculated to be required for pumping the given desired volume through a given sized tube set conduit.

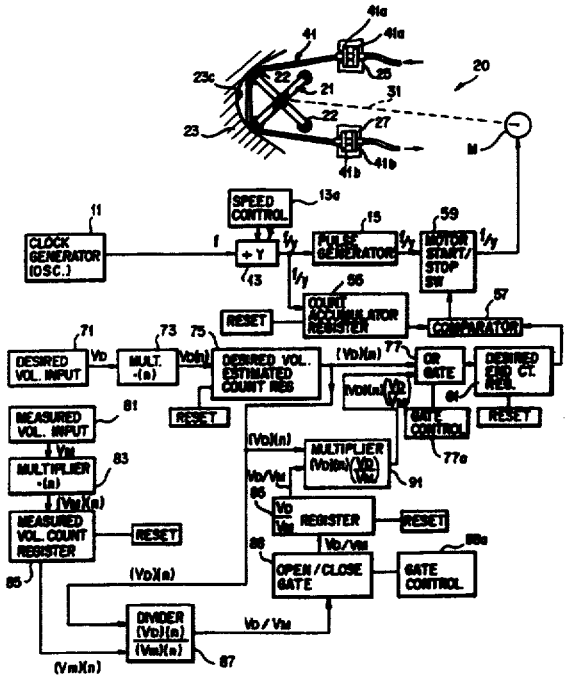

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 11, 14, 17, 19 and 22 are determined to be patentable as amended.

Claims 2–10, 12, 13, 15, 16, 18, 20, 21 and 23–31, dependent on an amended claim, are determined to be patentable.

1. The method of reducing inaccuracy in total quantity of fluid pumped by a pump comprising:

actuating a pump *at a given pump speed* through a first given amount of pump activity which is estimated will yield a first selected output quantity of a given fluid pumped through a given conduit based on assumed calibration factor of a selected amount of pump activity per unit volume dispensed, measuring the amount of the actual output quantity of said fluid which is pumped through said conduit by said first given amount of pump activity, and applying an adjustment factor to the amount of pump activity which would be calculated to be required based on said assumed calibration factor, for further pumping activity *at the same given pump speed* to effect selected further pumped output quantity production, said adjustment factor when applied as a multiplier being equal to the ratio of said first selected output quantity of fluid pumped relative to said measured actual output quantity of fluid pumped, for further pumping of a said selected further output quantity.

11. The method of reducing inaccuracy in the amount of output fluid pumped through a conduit by a digitally incrementally operable pump, comprising actuating a digitally incrementally operable pump *at a given pump speed* through a first given amount of pump activity represented by a first quantity of digital increments, which is estimated will yield a first selected output quantity of a given fluid pumped through a given conduit based on an assumed calibration factor of a selected amount of pump activity per unit volume dispensed, measuring the amount of the actual output quantity of said fluid which is pumped through said conduit by said first given amount of pump activity represented by said first quantity of digital increments, applying an adjustment factor to the amount of pump activity which would be calculated to be required based on said assumed calibration factor, for further pumping activity *at the same given pump speed* to effect selected further pumped output quantity production, said adjustment factor when applied as a multiplier being equal to the ratio of said first selected output quantity of fluid pumped relative to said measured actual output quantity of fluid pumped as a result of said estimated number of increments of actuation of said pump, for further pumping of a said selected further pumped output quantity, and subsequently pumping a selected output quantity of said given fluid through said conduit by actuating said pump *at the same given pump speed through* a number of increments equal to the product of said estimated quantity of increments corresponding to said selected output quantity multiplied by said adjustment factor.

14. The method of reducing inaccuracy in the output amount of a given fluid pumped through a selected conduit by a stepping motor-driven pump, comprising pulsing a stepping motor-actuated pump *at a given pump speed through* a given number of actuating pulses estimated as corresponding to a first desired output quantity of selected fluid output of a given fluid through a selected conduit based on a first ratio of n estimated pulses/unit volume pumped, and said number of pulses being equal to the product of said desired quantity of selected fluid multiplied by said first ratio, measuring the actual first output quantity of said given fluid pumped through said conduit as a result of pulse-actuating said pump said given number of actuating pulses, and subsequently pulsing said stepping motor-actuated pump *at the same given pump speed* for outputting any selected user quantity of said given fluid through said conduit by pulsing said stepping motor-actuated pump a number of pulses equal to the product of said selected user quantity of fluid multiplied by said first ratio and by a further second corrective adjustment factor which is the ratio formed by said first desired output quantity divided by said measured actual first output quantity.

17. A pump arrangement enabling reduction of inaccuracy in the amount of output fluid pumped through a conduit by a digitally incrementally operable pump, comprising a digitally incrementally operable pump, means for actuating said pump *at a given pump speed* through a first given amount of pump activity represented by a first quantity of digital increments, which is estimated will yield a first selected output quantity of a given fluid pumped through a given conduit based on an assumed calibration factor of a seleced amount of pump activity per unit volume dispensed, means for applying an adjustment factor to the amount of pump activity which would be calculated to be required based on said assumed calibration factor, for further pumping activity to effect selected further pumped output quantity production, said adjustment factor being applied as a multiplier which is equal to the ratio of said first selected output quantity of fluid pumped relative to an actual measured output quantity of fluid pumped through a said given conduit as a result of said estimated number of increments of actuation of said pump, and means for subsequently pumping a selected output quantity of said given fluid through said conduit by actuating said pump *at the same given pump speed* a number of increments equal to the product of said adjustment factor and said estimated quantity of increments corresponding to said selected output quantity.

19. A pump arrangement which enables reduction of inaccuracy in the output amount of a given fluid pumped through a selected conduit by a pulse-actuated pump, coprising:

a digital pulse-actuated pump, means for pulsing said pump *at a given pump speed through* a given number of actuating pulses estimated as corresponding to a first desired output quantity of a selected fluid output by said pump of a given fluid through a selected conduit based on a first ratio of a estimated pulses/unit volume pumped, and said number of pulses being equal to the product of said desired quantity of selected fluid multiplied by said first ratio, and means for subsequently pulsing said digital pulse-actuated pump *at the same given pump speed* for outputting any selected user quantity of said given fluid through said conduit by pulsing said digital pulse-actuated pump *at the same given pump speed through* a number of pulses equal to the product of said selected user quantity of fluid multiplied by said first ratio and by a further second corrective adjustment factor which is the ratio formed by said first desired output quantity divided by an actual first output quantity from said pump when said pump is actuated a number of pulses equal to said product of said desired quantity multiplied by said first ratio.

22. A pump arrangement enabling reduction of inaccuracy in total quantity of fluid pumped by a pump, comprising:

a pump, means for actuating said pump *at a given pump speed* through a first given amount of pump activity which is estimated will yield a first selected output quantity of a given fluid pumped through a given conduit based on an assumed calibration factor of a selected amount of pump activity per unit volume dispensed, and means for applying an adjustment factor to the amount of pump activity which would be calcualated to be required based on said assumed calibration factor, said adjustment factor being a multiplier which is equal to the ratio of said first selected output quantity of fluid pumped relative to an actual measured output quantity of fluid pumped through a said given conduit by said pump when said pump is actuated by said first given amount of pump activity, for further pumping of *a* [said] further selected output quantity *at the same given pump speed.*

* * * * *